US010731348B2

(12) United States Patent
Sargent et al.

(10) Patent No.: US 10,731,348 B2
(45) Date of Patent: Aug. 4, 2020

(54) SKYLIGHT AND CURB ASSEMBLY AND METHODS FOR INSTALLING AND FABRICATING SAME

(71) Applicant: VKR HOLDING A/S, Horshølm (DK)

(72) Inventors: Max LaForrest Sargent, Greenwood, SC (US); Charles Joseph Rimsky, Greenwood, SC (US); Steve Roy Kastner, Greenwood, SC (US); Brian Jefferson Burkes, Greenwood, SC (US)

(73) Assignee: VKR HOLDING A/S, Horsholm (DK)

( * ) Notice: Subject to any disclaimer, the term of this patent is extended or adjusted under 35 U.S.C. 154(b) by 0 days.

(21) Appl. No.: 16/377,485

(22) Filed: Apr. 8, 2019

(65) Prior Publication Data

US 2019/0234073 A1 Aug. 1, 2019

Related U.S. Application Data

(62) Division of application No. 15/714,686, filed on Sep. 25, 2017, now Pat. No. 10,294,671.

(60) Provisional application No. 62/399,867, filed on Sep. 26, 2016.

(51) Int. Cl.
*E04D 13/03* (2006.01)

(52) U.S. Cl.
CPC ..... *E04D 13/0315* (2013.01)

(58) Field of Classification Search
CPC ..... E04D 13/0315
USPC ..... 52/200
See application file for complete search history.

(56) References Cited

U.S. PATENT DOCUMENTS

| | | | |
|---|---|---|---|
| 2,851,973 | A | 9/1958 | Lenke |
| 4,514,944 | A | 5/1985 | Doell |
| 4,520,604 | A | 6/1985 | Halsey et al. |
| 4,589,238 | A | 5/1986 | Sampson et al. |
| 4,702,049 | A | 10/1987 | Sampson et al. |
| RE32,539 | E | 11/1987 | Jentoft et al. |
| 4,703,592 | A | 11/1987 | Sampson et al. |
| 4,781,008 | A | 11/1988 | Lyons, Jr. |
| 4,896,468 | A | 1/1990 | Sampson et al. |
| 4,930,275 | A | 6/1990 | Verby et al. |
| 4,941,300 | A | 7/1990 | Lyons, Jr. |
| 4,972,638 | A | 11/1990 | Minter |
| 5,044,133 | A | 9/1991 | Sampson et al. |
| 5,046,292 | A | 9/1991 | Sampson et al. |
| 5,102,603 | A | 4/1992 | Oblath |

(Continued)

FOREIGN PATENT DOCUMENTS

DE 19830324 A1 1/2000

*Primary Examiner* — Jeanette E Chapman
(74) *Attorney, Agent, or Firm* — Parker Poe Adams & Bernstein LLP

(57) ABSTRACT

A prefabricated skylight and curb assembly and method for installing and fabricating same is disclosed. The skylight and curb assembly of the present invention may include a roof curb, a skylight, and a locking cap. The roof curb may define an outer perimeter and an inner open perimeter. Further, the roof curb may include a lower end for securing to a roof structure and an upper end for rigidly securing the skylight. The locking cap may include a retainer and a cover. The retainer may be disposed on the outer perimeter of the roof curb between the upper and lower ends. The cover may be adjustably secured to the retainer so that the cover may be moveable between a generally vertical position and a generally horizontal position.

13 Claims, 7 Drawing Sheets

(56) References Cited

U.S. PATENT DOCUMENTS

| | | | |
|---|---|---|---|
| 5,357,720 | A | 10/1994 | O'Keeffe et al. |
| 5,553,425 | A | 9/1996 | Sampson |
| 5,682,713 | A | 11/1997 | Weiss |
| 5,913,765 | A | 6/1999 | Moller et al. |
| 5,953,869 | A | 9/1999 | Balfour et al. |
| 5,960,596 | A | 10/1999 | Lyons, Sr. |
| 6,052,956 | A | 4/2000 | Hoy et al. |
| 6,195,948 | B1 | 3/2001 | Lamanna |
| 6,263,624 | B1 | 7/2001 | Hoy et al. |
| 6,418,679 | B2 | 7/2002 | Widmer |
| 6,640,508 | B2 | 11/2003 | Lindgren |
| 7,331,145 | B2 | 2/2008 | Feucht et al. |
| 7,386,958 | B2 | 6/2008 | Quarles |
| 8,701,355 | B2 * | 4/2014 | Sexton ..... E04D 13/1475 52/58 |
| 8,833,010 | B1 | 9/2014 | Schlabach |
| 9,187,905 | B2 | 11/2015 | Smith |
| 2006/0272232 | A1 | 12/2006 | Fooks |

* cited by examiner

SKYLIGHT AND CURB ASSEMBLY AND METHODS FOR INSTALLING AND FABRICATING SAME

CROSS-REFERENCE TO RELATED APPLICATIONS

This application is related to and claims priority to U.S. Provisional Patent Application No. 62/399,867 filed Sep. 26, 2016 and is a divisional patent application of U.S. Utility patent application Ser. No. 15/714,686 filed Sep. 25, 2017, which are both incorporated herein by reference.

BACKGROUND

The present invention relates generally to a prefabricated skylight and curb assembly and methods for installing and fabricating same. More particularly, the invention relates to a skylight and curb assembly incorporating a locking cap having a retainer and a rotatable cover for assisting with installation of roofing membrane, such as thermoplastic polyolefin (TPO), and insulation and providing streamlined installation of the skylight and curb assembly to the roof of a structure.

Skylights are incorporated into buildings, houses, and other structures. They often reduce energy consumption by infusing desirable natural light into the interior of a structure, thereby decreasing dependency on artificial lighting. Water penetration and moisture infiltration into a skylight structure, however, are often concerns with skylights.

Traditionally, skylights are installed by first constructing and securing a roof curb to the roof of a structure at the position where the skylight is to be mounted. A waterproofing membrane, such as TPO, is then affixed to the roof, including being wrapped over and around the roof curb walls, to prevent water penetration. A skylight may then be secured to the roof curb.

In some applications, issues may arise with this multi-step skylight and curb installation process because the skylight curbs are not appropriately shaped and/or sized to securely receive the skylight. Additionally, the installation process may be cumbersome because multiple steps are required at the installation site, and/or the multiple steps may each increase the risk of error during fabrication on-site.

Thus, there is a need for a prefabricated skylight and curb assembly that is simple and easy to install to a roof structure at the installation site while also allowing for effective configuration of waterproofing membrane and insulation to the skylight curb.

SUMMARY

The present invention includes a skylight and curb assembly. In one embodiment of the skylight and curb assembly, the assembly may include a roof curb, a skylight, and a locking cap. The roof curb may define an outer perimeter and an inner open perimeter. Further, the roof curb may include a lower end for securing to a roof structure and an upper end for securing the skylight. The locking cap may include a retainer and a cover. The retainer may be disposed outboard of the roof curb between the upper and lower ends. The cover may be adjustably secured to the retainer so that the cover may be moveable between a generally vertical position and a generally horizontal position.

In another embodiment of the skylight and curb assembly, the assembly may include a roof curb, a skylight, and a locking cap having a retainer and a moveable cover. The roof curb may define an outer perimeter and an inner open perimeter. The roof curb may further have a lower end for securing to a roof structure and an upper end for rigidly securing the skylight. The retainer may define a retainer profile having a generally vertically extending member with an upper portion, a lower portion, a curb side, and a cover side. The retainer profile may further include retainer legs disposed on the cover side of the generally vertically extending member of the retainer profile. The cover may define a cover profile having a generally vertically extending member with an upper portion, a lower portion, a retainer side, and an outer side. The cover profile may further include cover legs disposed on the generally vertically extending member of the cover profile. The retainer may be disposed on the outer perimeter of the roof curb between the upper and lower ends of the roof curb. Further, the cover may be adjustably attached to the retainer so that the cover is movable between a generally vertical locked position and a generally horizontal unlocked position.

The skylight and curb assembly of the present invention may further include a barrier for positioning at corners of the roof curb. Further, the assembly may include a corner cap for securing at curb corners between the cover and the skylight. The assembly may also include a gasket for positioning between the roof curb and the cover when the cover is in the generally vertical position. In one embodiment of the skylight and curb assembly of the present invention, the locking cap extends around the entire outer perimeter of the roof curb. For example, the retainer and/or the cover may extend around the entire perimeter of the roof curb.

The present invention also includes a method of fabricating a skylight and curb assembly. In one embodiment, the method includes the step of providing a roof curb defining an outer perimeter and an inner open perimeter. In one embodiment, the roof curb further has a lower end for securing to a roof structure and an upper end. The method may further include the steps of providing a locking cap having a retainer and a cover, rigidly securing the retainer to the outer perimeter of the roof curb between the upper and lower ends, and adjustably securing the cover to the retainer so that the cover is moveable between a generally vertical position and a generally horizontal position relative to the retainer. The method may also include the steps of providing a skylight structure and securing the skylight structure to the upper end of the roof curb.

The present invention also includes a method of installing a skylight and curb assembly to a roof structure. In one embodiment, the method includes the step of providing a skylight and curb assembly having a roof curb, a locking cap, and a skylight. In one embodiment, the roof curb defines an outer perimeter and an inner open perimeter. The roof curb may further have a lower end for securing to a roof structure and an upper end for securing the skylight. The locking cap may include a retainer and a cover. The retainer may be disposed on the outer perimeter of the roof curb between the upper and lower ends. The cover may be adjustably secured to the retainer so that the cover is moveable between a generally vertical position and a generally horizontal position. The method may further include the steps of securing the skylight to the upper end of the roof curb, securing the skylight and curb assembly to a roof structure, positioning the cover in the generally horizontal position, securing roofing membrane to the roof curb; and positioning the cover in the generally vertical position over at least a portion of the roofing membrane after the roofing membrane has been secured to the roof curb.

DETAILED DESCRIPTION OF REPRESENTATIVE EMBODIMENTS

The present invention relates to a skylight and curb assembly and method of fabricating and installing same. The skylight and curb assembly of the present invention may be prefabricated and fully assembled prior to transporting to an installation site. Additionally, the skylight and curb assembly of the present invention preferably maintains a leak-proof design while still allowing for securing of roofing membrane and/or insulation to the roof curb after the assembly is installed. Thus, the skylight and curb assembly of the present invention preferably allows for a better quality skylight and curb assembly while also allowing for easy and streamlined installation.

The composition, components, materials, sizes, and shapes of the skylight and curb assembly may vary. For example, the design of the assembly may vary depending upon size, shape, and material of the roof structure upon which the assembly is mounted. Additionally, the assembly may vary depending upon the degree of incline of the mounting surface. Although primarily described herein in terms of its use as a prefabricated skylight and curb assembly that provides a better quality and more leak-proof design, it will be clear that the apparatus and method of the present invention may provide additional benefits. Further, the primary components of the skylight and curb assembly as described herein may be combined with additional components and materials without departing from the spirit and the scope of the present invention. The invention will be described with reference to the figures which are an integral non-limiting component of the invention. Throughout the description similar elements will be numbered accordingly.

Figure 1:
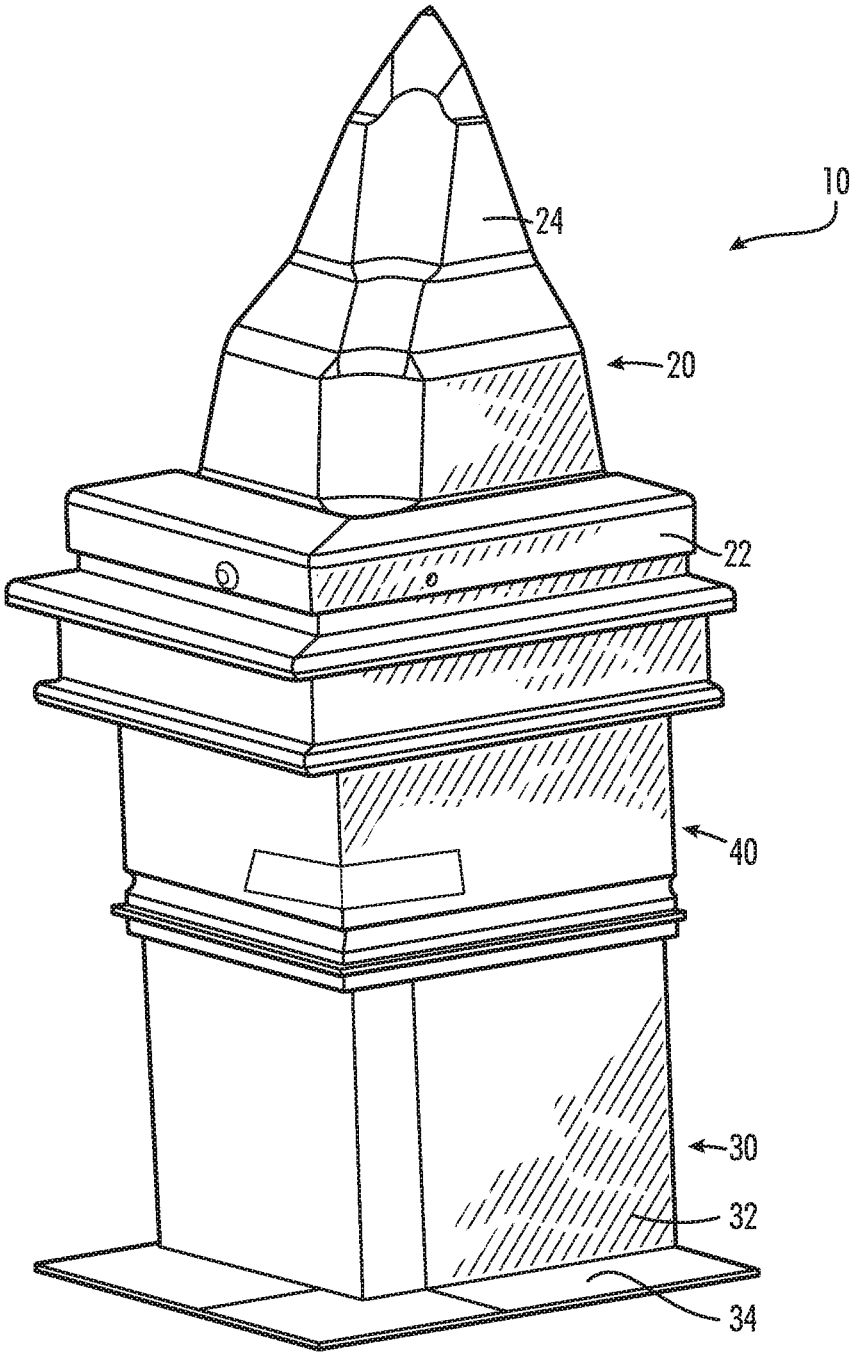
FIG. 1 is a partial perspective view of an embodiment of the skylight and curb assembly of the present invention.

FIG. 1 discloses an embodiment of an assembled skylight and curb assembly 10 of the present invention. As shown, the assembly 10 includes a skylight 20, a roof curb 30, and a locking cap 40. The skylight 20 may include a skylight frame 22 and lens 24. The roof curb 30 secures a skylight and may include a support 32 and a base 34 such as flashing. The base 34 of the roof curb 30 is typically for waterproofing and securing the assembly to a roof structure. The support 32 typically extends upward from the base to secure the locking cap 40 and provide for mounting and securing of a skylight 20. The support 32 may include insulation material extending directly from the base 34 and a wood nailer extending above the insulation material for securing the locking cap 40 and/or the skylight 20. Additionally, a steel curb frame may extend from the base 34 around support 32. In one embodiment of the present invention, the skylight and curb assembly 10 is prefabricated so that the entire assembly is connected together and shipped and ready for securing to a roof structure at an installation site.

In the illustrated embodiment of FIG. 1, the skylight and curb assembly 10 is a partial view of a generally rectangular assembly. In alternative embodiments of the present technology, the skylight assembly may be of shapes other than rectangular. The skylight assembly may be mounted on a horizontal or angled roof structure.

Figure 2:
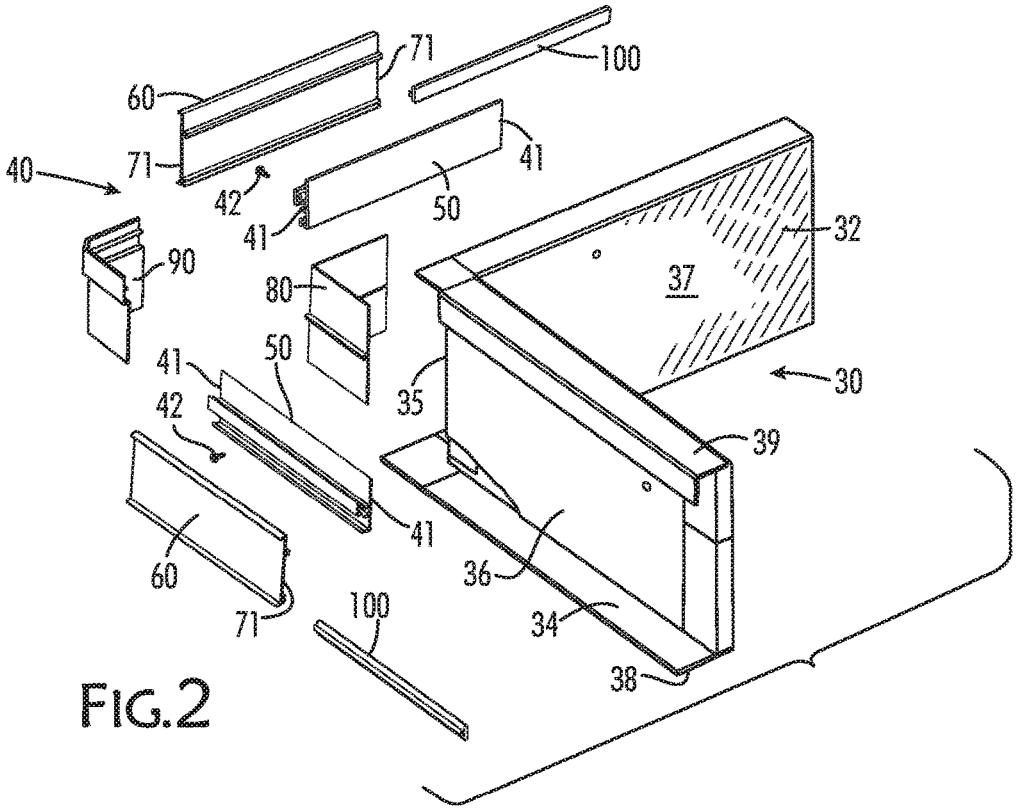
FIG. 2 is an exploded view of a locking cap and roof curb according to an embodiment of the skylight and curb assembly of the present invention.

FIG. 2 discloses an exploded view of an embodiment of the locking cap 40 and roof curb 30 of the present invention. The roof curb 30 of FIG. 2 may illustrate a partial roof curb. Typically, the roof curb forms an open interior such as a rectangular shape. The roof curb 30 may define an outer perimeter 36 and an inner open perimeter 37. Further, the roof curb may include a base 34 including flashing at the lower end 38 of the roof curb for securing to a roof structure and a support 32 at an upper end 39 for securing the skylight and locking cap. Preferably the skylight is rigidly secured to the upper end 39 at the upper edge of the roof curb.

Figure 3A:
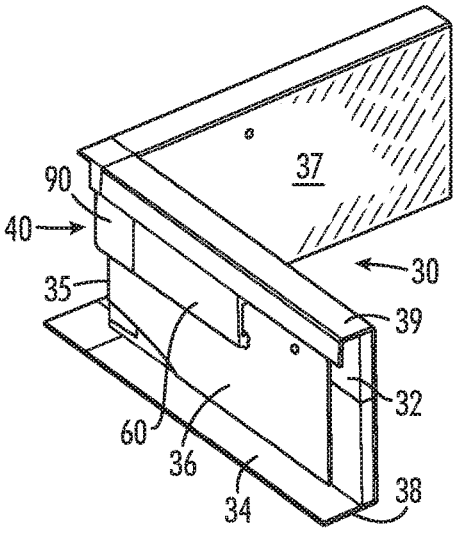
FIGS. 3A and 3B are perspective views of a locking cap and roof curb according to an embodiment of the skylight and curb assembly of the present invention.
Figure 3B:
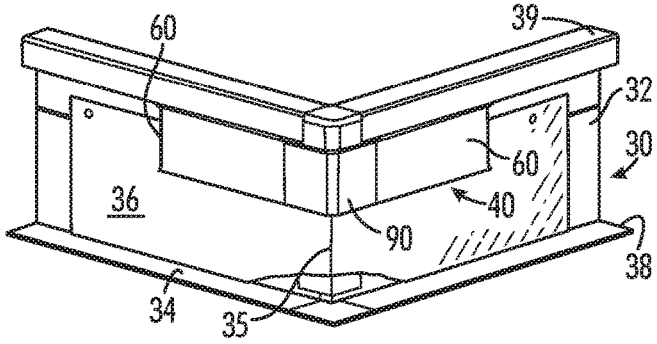
Figure 4A:
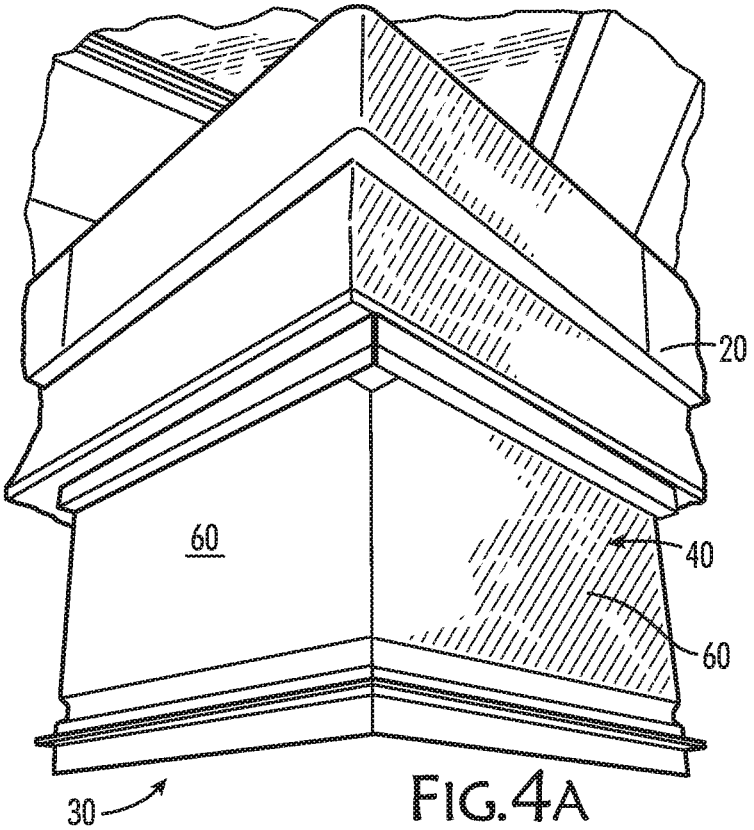
FIG. 4*a* is a perspective view of a skylight and curb assembly according to an embodiment of the present invention with the cover in a generally vertical orientation.
Figure 4B:
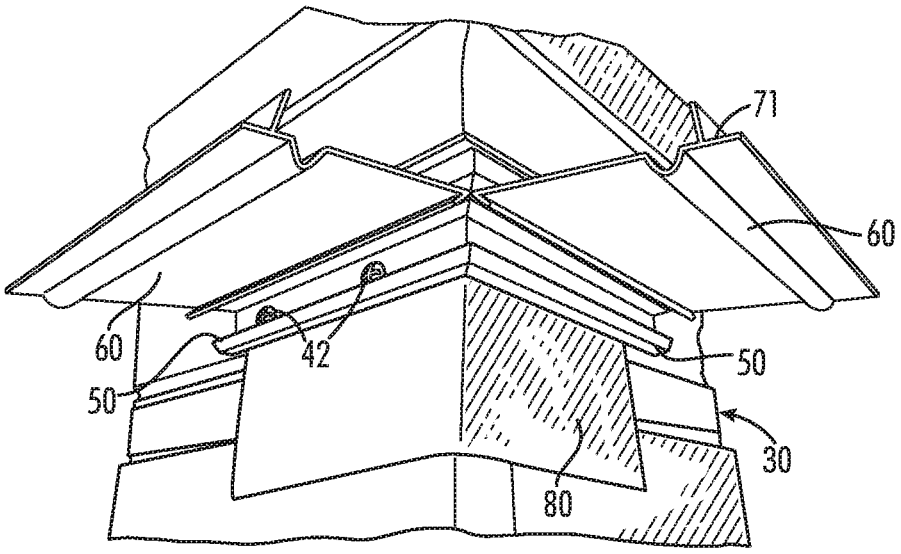
FIG. 4*b* is a perspective view of a skylight and curb assembly according to an embodiment of the present invention with the cover in a generally horizontal orientation

As shown in FIG. 2, the locking cap 40 may include a retainer 50 and an adjustable or movable cover 60. FIGS. 3A and 3B illustrate an embodiment of the locking cap 40 secured to the roof curb 30. As illustrated, the retainer 50 may be disposed on the outer perimeter 36 of the roof curb 30 between the upper and lower ends, 38 and 39, respectively, outboard of the roof curb 30. In one embodiment, the retainer 50 may be rigidly secured to the outer perimeter 36 of the roof curb 30 such as by welding or fasteners including screws 42. In an alternative embodiment, the retainer 50 may be formed integrally with the roof curb 30 such as by incorporating ridges, ribs, notches, and/or other securing features on the surface of the roof curb 30. The cover 60 may be adjustably secured to the retainer 50 so that the cover 60 may be moveable between a generally vertical position as shown in FIG. 4A and a generally horizontal position as shown in FIG. 4B. In one embodiment, the generally vertical position is a locked position because the cover 60 is locked and secured in place with respect to the assembly and the generally horizontal position is an unlocked position because the cover is adjustable with respect to the assembly.

The retainer and cover may be formed of various materials and formed using various methods. In one embodiment, the retainer and/or cover are formed by extrusion techniques. The retainer and cover may be formed of the same or different materials. Preferably the components of the locking cap 40 of the present invention are formed of weather resistant materials. In one embodiment, the retainer and/or cover may be composed of an aluminum alloy such as 6063-T5 aluminum alloy.

As illustrated in FIG. 2, the skylight and curb assembly of the present invention may further include a barrier 80 for positioning at corners 35 of the roof curb 30. In one embodiment, the barrier 80 is a corner wrap or a flat sheet secured over the corners 35 to provide protection against water and condensation entering the assembly 10. The barrier 80 may be formed of various materials. Preferably, the barrier 80 is composed of water resistant materials such as rubbers, elastomers, and/or polymers. In one embodiment, the barrier 80 may be formed of a synthetic rubber such as ethylene propylene diene monomer (EPDM).

For additional protection against water leakage at the corners, the assembly may further include a corner cap 90 for securing at one or more curb corners on the outer side of the cover 60. In one embodiment, the corner cap 90 is positioned between the cover 60 and the skylight 20. The corner cap 90 may be formed of various materials and formed using various techniques. In one embodiment, the corner cap 90 may be formed using injection molding. In another embodiment, the corner cap 90 may be composed of polymers such as amorphous plastics. For example, the corner cap 90 may be composed of an acrylic-styrene-acrylonitrile (ASA) polymer. Preferably, the corner cap 90 is formed of weather resistant materials.

The assembly may also include a gasket 100, such as a bulb gasket, for positioning between the roof curb and the cover when the cover is in the generally vertical position. The gasket 100 may be formed of various materials and formed using various methods. In one embodiment, the gasket is formed using extrusion techniques. Preferably, the gasket 100 is composed of water resistant materials such as rubbers, elastomers, and/or polymers. In one embodiment, the gasket 100 is formed of a synthetic rubber such as an ethylene propylene diene monomer (EPDM) rubber.

In one embodiment of the skylight and curb assembly 10 of the present invention, such as illustrated in FIG. 1, the locking cap 40 extends around the entire outer perimeter of the roof curb 30. For example, the retainer 50 and/or the cover 60 may extend around the entire outer perimeter 36 of the roof curb 30. In an alternative embodiment, such as shown in FIGS. 4A and 4B, the locking cap 40 extends only partially around the outer perimeter of the roof curb 30.

In one embodiment of the present invention, the outer perimeter 36 of the roof curb 30 may form a generally rectangular shape. Further, the locking cap 40 may include at least four independently movable covers 60 to surround a rectangular roof curb 30 on all four sides. For example, the at least four independently movable covers 60 may form a generally rectangular shape around the roof curb 30 when the at least four independently movable cover are all in the generally vertical position such as shown in FIG. 4A. In one embodiment, the ends 71 of the cover may be angled to provide a rectangular shape around the roof curb 30. For example, an end 71 that adjoins with another end 71 may each be angled to 45 degrees so that the ends 71 are close-fitted together when covers 60 are vertically-positioned. In one embodiment of the present invention, the locking cap 40 may include at least four retainers. Each of the ends 41 of adjoining retainers may be angled, such as to 45 degrees, to form a close-fit rectangular shape around the roof curb 30.

Figure 5:
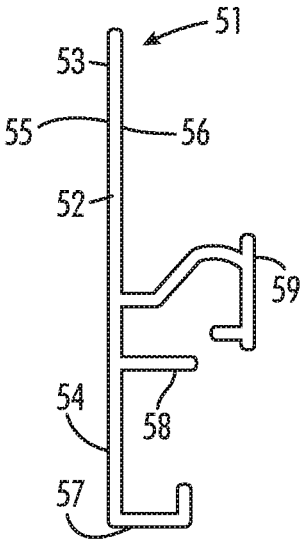
FIG. 5 is a side profile view of a retainer of a locking cap according to an embodiment of the skylight and curb assembly of the present invention.

In one embodiment of the present invention as illustrated in FIG. 5, the retainer defines a retainer profile 51. The retainer profile 51 may have a generally vertically extending member 52 with an upper portion 53, a lower portion 54, a curb side 55, and a cover side 56. The curb side 55 is the side of the generally vertically extending member 52 positioned proximate to the roof curb 30. Likewise, the cover side 56 is the side of the generally vertically extending member 52 opposite side 55. The retainer profile may further include retainer legs. The retainer legs may be disposed on the cover side 56 of the generally vertically extending member 52 of the retainer profile 51. In one embodiment, the retainer legs include first, second, and third legs, 57, 58, and 59, respectively, each extending generally horizontally from the cover side 56 of the generally vertically extending member 52. As shown in the embodiment of FIG. 5, the first leg 57 may form a generally L shape, the second leg 58 may form a generally I shape, and/or the third leg 59 may form a hooked shape. Alternative retainer leg shapes and arrangements are contemplated without departing from the spirit and the scope of the present invention. In one embodiment, the first, second, and third legs, 57, 58, and 59, respectively, may be positioned along the lower portion 54 of the generally vertically extending member 52. In another embodiment, the retainer 50 may be secured to the roof curb 30 between the first leg 57 and second leg 58, such as by a screw 42 (shown in FIGS. 2 & 4B) inserted through an opening in the retainer 50.

Figure 6:
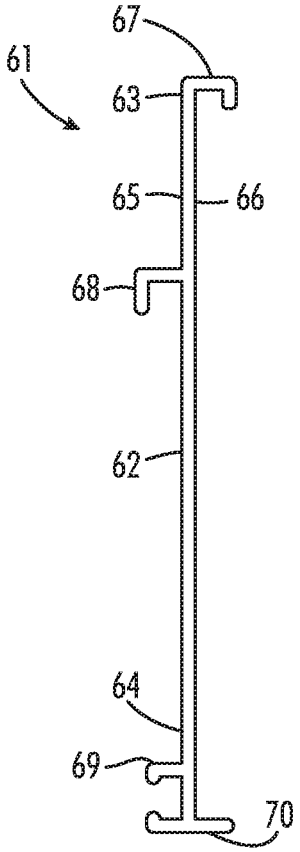
FIG. 6 is a side profile view of a cover of a locking cap according to an embodiment of the skylight and curb assembly of the present invention.

In one embodiment of the present invention as illustrated in FIG. 6, the cover 60 defines a cover profile 61. The cover profile 61 may have a generally vertically extending member 62 with an upper portion 63, a lower portion 64, a retainer side 65, and an outer side 66. The retainer side 65 is the side of the generally vertically extending member 62 positioned proximate to the retainer 50 or roof curb 30. Likewise, the outer side 66 is the side of the generally vertically extending member 62 opposing the retainer side 65. The cover profile 61 may include cover legs. The cover legs may be disposed on the generally vertically extending member 62 of the cover profile 61. In one embodiment, the cover legs include first, second, third, and fourth legs, 67, 68, 69, and 70, respectively, each extending generally horizontally from the generally vertically extending member 62. As shown in the embodiment of FIG. 6, the first leg 67 may form a generally L shape from the outer side 66 of the generally vertically extending member 62, the second leg 68 may form a generally L shape from the retainer side 65 of the generally vertically extending member 62, the third leg 69 may form a generally L shape from the retainer side 65 of the generally vertically extending member 62, and/or the fourth leg 70 may form a generally L shape from the retainer side 65 of the generally vertically extending member 62 and an I shape from the outer side 66 of the generally vertically extending member 62. Alternative cover leg shapes and arrangements, for complementary engagement with the retainer legs, are contemplated without departing from the spirit and the scope of the present invention. In one embodiment, the first leg 67 and second leg 68 may be positioned along the upper portion 63 of the generally vertically extending member 62 and the third leg 69 and fourth leg 70 may be positioned along the lower portion 64 of the generally vertically extending member 62.

Figure 7:
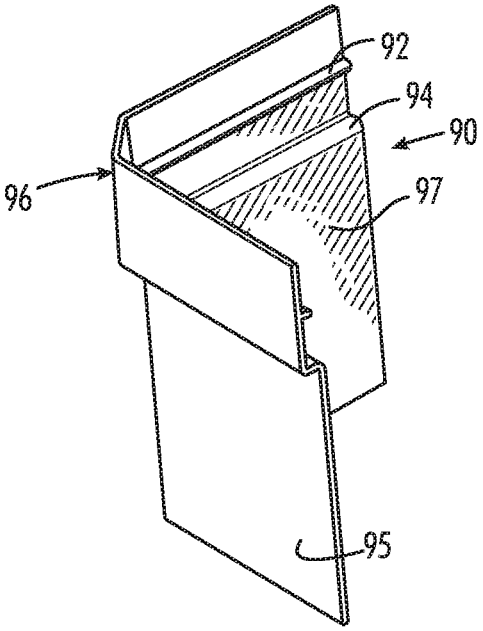
FIG. 7 is a perspective view of a corner cap of a locking cap according to an embodiment of the skylight and curb assembly of the present invention.

FIG. 7 illustrates an embodiment of a corner cap 90 of the present invention. Corner cap 90 may include a locking rib 92 for securely locking into leg 59 of retainer 50. Additionally, a ridge 94 may be incorporated into corner cap 90 for aesthetic purposes or to allow for proper drainage of water that may contact the assembly 10. In the embodiment disclosed in FIG. 7, the corner cap 90 may include a first surface 95, a second surface 96, and a third surface 97. The first surface 95 and third surface 97 may be positioned at right angles to each other with the second surface 96 positioned at an intersecting angle there between. In the embodiment shown in FIG. 7, the second surface 96 of the corner cap is positioned at an approximately 45 degree angle to the first surface 95 and the second surface 97. The corner cap may be positioned just at the corners of the roof curb 30. Alternatively, the corner cap may extend around the entire outer perimeter 36 of the roof curb 30. Corner cap 90 may be incorporated for additional water resistance of the assembly 10, such as when it extends around the entire outer perimeter 36 of the roof curb 30.

Preferably the design of the skylight and curb assembly of the present invention provides minimal-to-no gaps or spaces for water penetration into the interior of the skylight or roof curb. Thus, the design of the present invention preferably allows for improved waterproofing. Additional components may be incorporated into the assembly of the present invention to provide additional moisture control without departing from the spirit and scope of the present invention.

Because the retainer and cover may be constructed using long extrusions, strengthening and/or compression ribs may be incorporated along the retainers and covers of the present invention without departing from the scope of the present invention. Moreover, additional securing legs, members, and securing elements may be incorporated into the retainers and covers of the present invention without departing from the scope of the present invention. Optional accessories and feature may also be incorporated into the skylight and curb assembly 10 of the present invention without departing from the spirit and scope of the present invention.

Figure 8A:
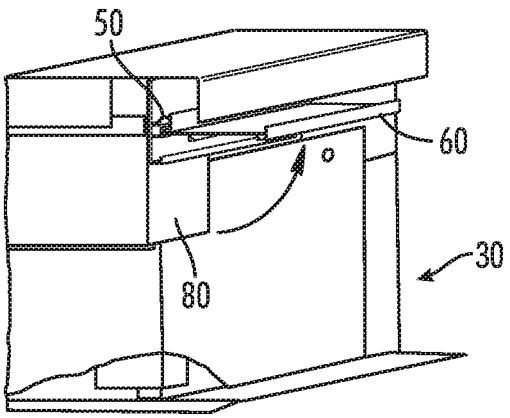
FIGS. 8*a*-8*d* illustrate steps of a method of fabricating a skylight and curb assembly according to an embodiment of the present invention.
Figure 8B:
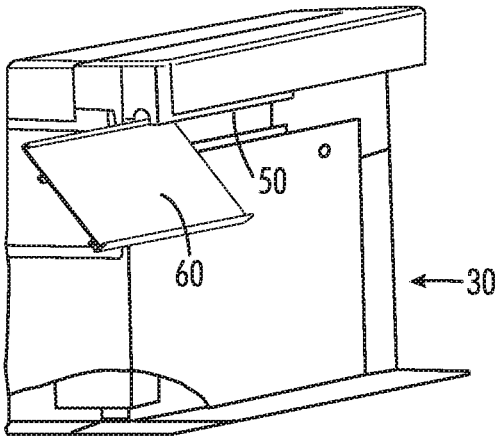

The present invention also includes a method of fabricating a skylight and curb assembly. In one embodiment, the method includes the step of fabricating and/or providing a roof curb 30 defining an outer perimeter and an inner open perimeter. In one embodiment, the roof curb further has a lower end for securing to a roof structure and an upper end. The method may further include the steps of providing a locking cap having a retainer 50 and a cover 60. The retainer may be secured to the outer perimeter of the roof curb between the upper and lower ends such as shown in FIG. 8*a*. In one embodiment, the retainer may be rigidly secured using fasteners extending through openings in the retainer and into the roof curb support. Alternatively, the retainer may be welded to the roof curb support. In yet a further alternative, the roof curb may have ridges, ribs, notches or other securing features integrally formed thereon to provide the retainer of the present invention. The method may further include the step of adjustably securing the cover to the retainer so that the cover is moveable between a generally vertical position and a generally horizontal position relative to the retainer. In one embodiment, the cover is adjustably secured to the retainer 50 by sliding the cover 60 into the retainer as shown in FIG. 8*b*. The configuration and design of the retainer and cover of the locking cap are such that the cover remains adjustable between the vertical and horizontal directions as shown in FIGS. 4A and 4B after the cover is secured within the assembly. The method may further include the steps of providing a skylight structure and securing the skylight structure to the upper end of the roof curb. In one embodiment, the skylight structure is secured to the upper end of the roof curb using fastener means, such as adhesives, bolts, screws, welding, brackets, and/or the like.

Figure 8C:
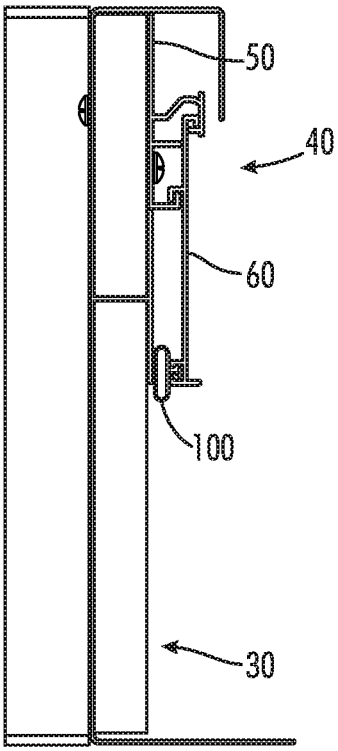
Figure 8D:
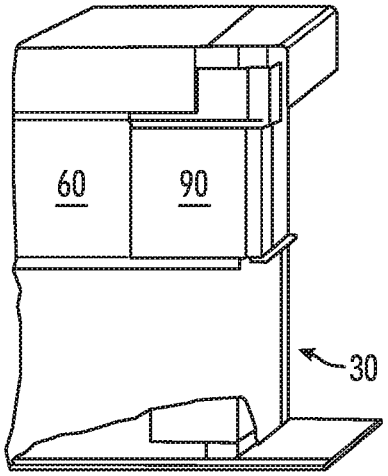

The method of fabricating a skylight and curb assembly of the present invention may also include the step of providing a barrier 80 and securing the barrier 80 to at least one or more corners of the roof curb. In one embodiment, the barrier is secured prior to securing the retainer. The method of fabricating a skylight and curb assembly of the present invention may also include providing a gasket 100 and/or inserting a gasket between the cover of the locking cap and the roof curb and/or barrier 80, such as shown in FIG. 8*c*. The gasket may act as a spacer to close any openings between the lower portion of the cover and roof curb. The method of fabricating a skylight and curb assembly of the present invention may also include providing a corner cap 90 and/or securing the corner cap 90 at the corners of the locking cap on the outer side of the cover as shown in FIG. 8*d*. In one embodiment, the corner cap 90 is secured after the assembly of the present invention is installed on a roof structure.

The present invention also includes a method of installing a skylight and curb assembly to a roof structure. In one embodiment, the method includes the step of providing a skylight and curb assembly having a roof curb, a locking cap, and a skylight. In one embodiment, the roof curb defines an outer perimeter and an inner open perimeter. The roof curb may further have a lower end for securing to a roof structure and an upper end for securing the skylight. The locking cap may include a retainer and a cover. The retainer may be disposed on the outer perimeter of the roof curb between the upper and lower ends. The cover may be adjustably secured to the retainer so that the cover is moveable between a generally vertical position and a generally horizontal position. In one embodiment, the locking cap further includes a barrier, gasket, and/or corner cap. The method may further include the steps of securing the skylight and curb assembly to a roof structure, positioning the cover in the generally horizontal position, securing roofing membrane to the roof curb, and positioning the cover in the generally vertical position over at least a portion of the roofing membrane after the roofing membrane has been secured to the roof curb.

Figure 9A:
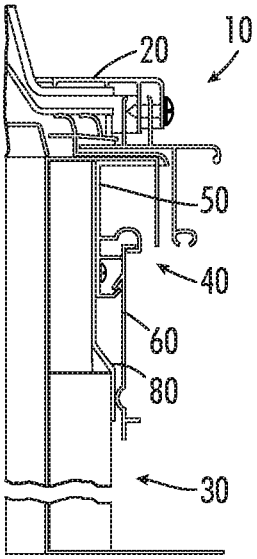
FIGS. 9*a*-9*i* illustrate steps of a method of installing a skylight and curb assembly to a roof membrane according to an embodiment of the present invention.
Figure 9B:
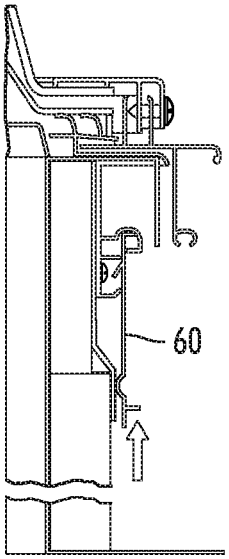
Figure 9C:
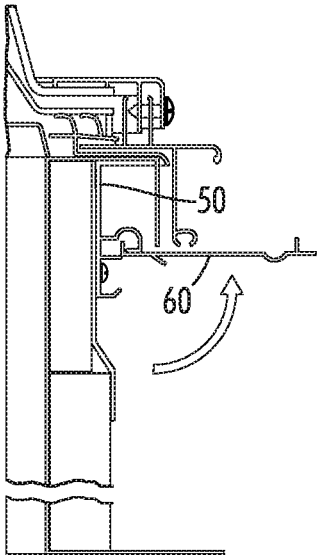
Figure 9D:
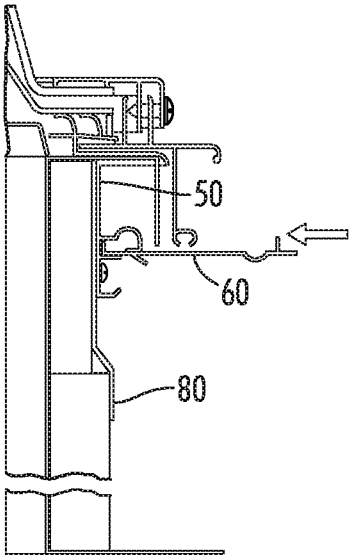
Figure 9E:
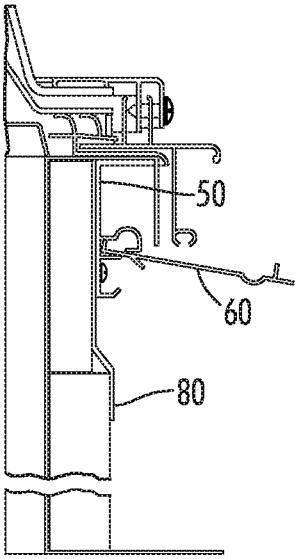
Figure 9F:
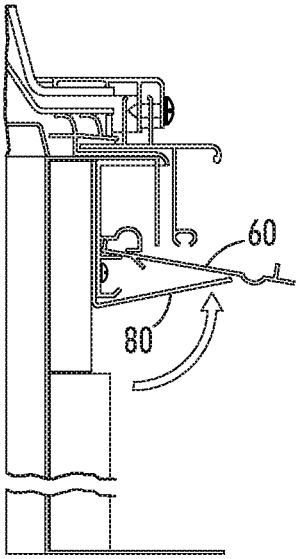
Figure 9G:
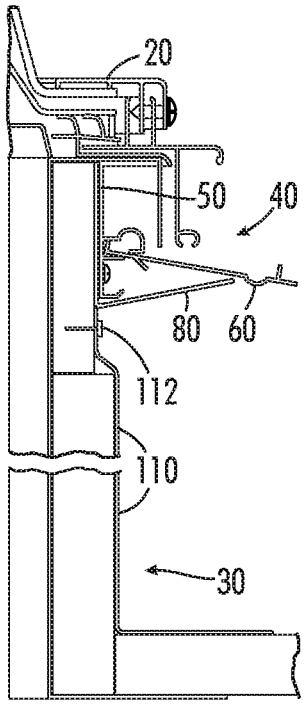
Figure 9H:
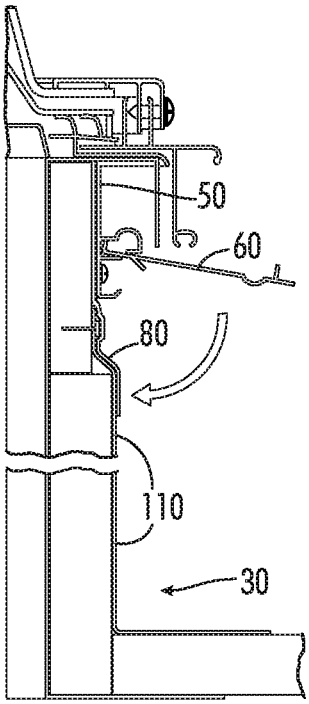
Figure 9I:
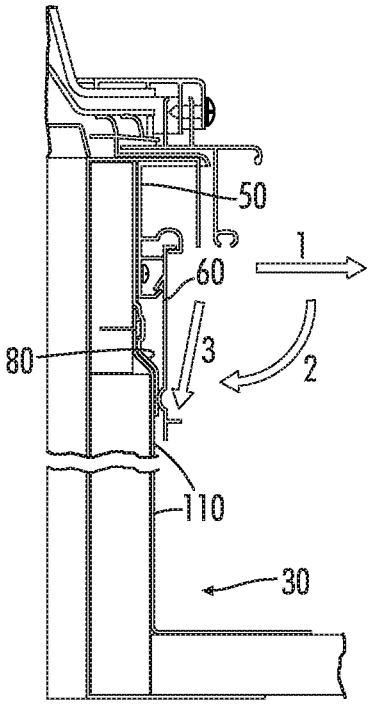

In an exemplary method of installing a skylight and curb assembly to a roof structure as illustrated in FIGS. 9*a*-9*i*, a skylight and curb assembly as disclosed herein is provided and secured to a roof structure at the base of the roof curb. In one embodiment, the roof curb is welded to the roof structure. In an alternative embodiment, the roof curb is bolted to the roof structure. The cover 60 of the locking cap 40 may be pushed upward to disengage the cover legs of the cover 60 from the retainer legs of the retainer 50 as shown in FIG. 9*b*. The cover 60 may then be rotated to a generally horizontal position as shown in FIG. 9*c*. In this embodiment, the cover legs of the cover 60 may be pushed into a slot formed between the retainer legs of the retainer 50 as shown in FIG. 9*d*. As shown in FIG. 9*e*, the design and configuration of the retainer legs and cover legs may be such that cover 60 is capable of locking in the generally horizontal position. The barrier 80 may then be adjusted or rotated upward to a generally horizontal position proximate to the cover 60 as shown in FIG. 9*f*. Roofing membrane 110 may then be installed on the roof curb 30. In one embodiment, the roofing member is installed using fasteners 112, such as nails or screws that are inserted into the support of the roof curb as shown in FIG. 9*g*. The barrier 80 may be transitioned back to a generally vertical position that covers a portion of the roofing membrane 110, including the fasteners 112, as shown in FIG. 9*h*. The cover legs of cover 60 may then be disengaged from the retainer legs of retainer 50 so that the cover 60 rotates or adjusts back to the generally vertical position shown in FIG. 9*i*. The cover legs of cover 60 may then engage the retainer legs of retainer 50 to removably lock the cover to the retainer 50. A corner cap 90 may then be installed at the corners of the assembly and on the outer side of the cover.

The methods of the present invention may include additional steps without departing from the spirit and scope of the present invention. Furthermore, unless otherwise explicitly stated herein, the steps of the method may be performed in various orders.

The skylight and curb assembly of the present invention is particularly suitable for use with many different types and forms of structures, including commercial, industrial, and residential structures. The skylight and curb assembly of the present invention includes a novel locking cap having a movable cover that provides a distinct advantage over traditional skylight and curb designs. Particularly, the design of the present invention allows for installation of roofing membrane and insulation to the roof curb with a fully assembled and constructed skylight and curb. Further, because the skylight and curb assembly of the present invention may be fully constructed and assembled prior to shipment to an installation field site, the design of the skylight and curb assembly of the present invention preferably allows for quick and easy installation at a field site.

While various embodiments and examples of this invention have been described above, these descriptions are given for purposes of illustration and explanation, and not limitation. Variations, changes, modifications, and departures from the apparatuses, systems, and methods disclosed above may be adopted without departure from the spirit and scope of this invention. In fact, after reading the above description, it will be apparent to one skilled in the relevant art(s) how to implement the invention in alternative embodiments. Thus, the present invention should not be limited by any of the above described exemplary embodiments.

Further, the purpose of the Abstract is to enable the various Patent Offices and the public generally, and especially the scientists, engineers, and practitioners in the art who are not familiar with patent or legal terms or phraseology, to determine quickly from a cursory inspection the nature and essence of the technical disclosure of the application. The Abstract is not intended to be limiting as to the scope of the invention in any way.

What is claimed is:

1. A locking cap for a skylight and curb assembly, the locking cap comprising:

a retainer defining a retainer profile having a generally vertically extending member having an upper portion, a lower portion, a curb side, and a cover side, the retainer profile further comprising retainer legs disposed on the cover side of the generally vertically extending member of the retainer profile, the curb side of the generally vertically extending member of the retainer profile is for positioning adjacent to an outer perimeter of a roof curb, and a cover defining a cover profile having a generally vertically extending member with an upper portion, a lower portion, a retainer side, and an outer side, the cover profile further comprising cover legs disposed on the generally vertically extending member of the cover profile, the retainer side of the generally vertically extending member of the cover profile is for positioning adjacent to the cover side of the generally vertically extending member of the retainer profile, wherein the cover is adjustably securable to the cover side of the retainer so that the cover is moveable between a generally vertical position and a generally horizontal position.

2. The locking cap of claim 1 wherein the retainer legs are positioned along the lower portion of the generally vertically extending member of the retainer profile.

3. The locking cap of claim 1 wherein the retainer legs include first, second, and third retainer legs each extending generally horizontally from the cover side of the generally vertically extending member.

4. The locking cap of claim 3 wherein the first, second, and third retainer legs are positioned along the lower portion of the generally vertically extending member of the retainer profile.

5. The locking cap of claim 3 wherein the first retainer leg forms a generally L shape, the second retainer leg forms a generally I shape, and the third retainer leg forms a hooked shape.

6. The locking cap of claim 3 wherein the retainer comprises an opening between the first and second retainer legs of the retainer profile for insertion of a securing device to secure the retainer to the roof curb.

7. The locking cap of claim 1 wherein the retainer legs extend generally horizontally from the generally vertically extending member of the retainer profile.

8. The locking cap of claim 1 wherein the cover legs include first, second, third, and fourth cover legs each extending generally horizontally from the generally vertically extending member of the cover profile.

9. The locking cap of claim 8 wherein the first cover leg forms a generally L shape from the outer side of the generally vertically extending member of the cover profile, the second cover leg forms a generally L shape from the retainer side of the generally vertically extending member of the cover profile, the third cover leg forms a generally L shape from the retainer side of the generally vertically extending member of the cover profile, and the fourth cover leg forms a generally L shape from the retainer side of the generally vertically extending member of the cover profile and an I shape from the outer side of the generally vertically extending member of the cover profile.

10. The locking cap of claim 8 wherein the first and second cover legs are positioned along the upper portion of the generally vertically extending member of the cover profile and the third and fourth cover legs are positioned along the lower portion of the generally vertically extending member of the cover profile.

11. The locking cap of claim 1 wherein the cover legs extend generally horizontally from the generally vertically extending member of the cover profile.

12. The locking cap of claim 1 wherein the locking cap comprises at least four retainers and at least four covers for securing around the outer perimeter of the roof curb.

13. The locking cap of claim 1 wherein at least one cover leg removably locks with at least one retainer leg.

* * * * *